US009455501B2

(12) United States Patent
Ziv et al.

(10) Patent No.: US 9,455,501 B2
(45) Date of Patent: Sep. 27, 2016

(54) BROADBAND MULTIPLE-INPUT MULTIPLE-OUTPUT ANTENNA

(71) Applicant: GALTRONICS CORPORATION LTD., Tiberias (IL)

(72) Inventors: Yaniv Ziv, Tiberias (IL); Haim Yona, Tiberias (IL)

(73) Assignee: GALTRONICS CORPORATION, LTD., Tiberias (IL)

( * ) Notice: Subject to any disclaimer, the term of this patent is extended or adjusted under 35 U.S.C. 154(b) by 183 days.

(21) Appl. No.: 14/311,906

(22) Filed: Jun. 23, 2014

(65) Prior Publication Data

US 2014/0375526 A1 Dec. 25, 2014

Related U.S. Application Data

(60) Provisional application No. 61/838,425, filed on Jun. 24, 2013.

(51) Int. Cl.

| | |
|---|---|
| ***H01Q 21/28*** | (2006.01) |
| ***H01Q 1/42*** | (2006.01) |
| ***H01Q 1/52*** | (2006.01) |
| ***H01Q 9/04*** | (2006.01) |

(52) U.S. Cl.

CPC ..... *H01Q 21/28* (2013.01); *H01Q 1/42* (2013.01); *H01Q 1/521* (2013.01); *H01Q 9/0421* (2013.01)

(58) Field of Classification Search

CPC ..... H01Q 21/28; H01Q 1/42; H01Q 1/521; H01Q 9/0421

USPC ..... 343/702, 893

See application file for complete search history.

(56) References Cited

U.S. PATENT DOCUMENTS 6,069,590 A * 5/2000 Thompson, Jr. ..... H01Q 1/42 343/795

6,667,549 B2 * 12/2003 Cahill ..... H01L 23/04 257/660

2004/0125027 A1 * 7/2004 Rubinshteyn ..... H01Q 1/241 343/702

2004/0207559 A1 * 10/2004 Milosavljevic ..... H01Q 1/243 343/702

2008/0094282 A1 * 4/2008 Qin ..... H01Q 9/42 343/700 MS

2008/0180333 A1 * 7/2008 Martiskainen ..... H01Q 1/243 343/722

2009/0207092 A1 * 8/2009 Nysen ..... H01Q 1/2275 343/876

2009/0273529 A1 * 11/2009 Liu ..... H01Q 1/243 343/725

(Continued)

FOREIGN PATENT DOCUMENTS

WO 2014/207741 12/2014

OTHER PUBLICATIONS

U.S. Appl. No. 61/838,425, filed Jun. 24, 2013.

(Continued)

*Primary Examiner* — Dameon E Levi
*Assistant Examiner* — AB Salam Alkassim, Jr.
(74) *Attorney, Agent, or Firm* — Lorenz & Kopf, LLP.

(57) ABSTRACT

An antenna, including a ground plane, a first radiating element mounted on the ground plane, a second radiating element mounted on the ground plane in spaced relation to the first radiating element, each one of the first and second radiating elements including a feed leg for feeding the radiating element, a ground leg for grounding the radiating element, an origami-like folded element having a first end and a second end, the first end being connected to the feed leg, the second end being capacitively coupled to the radiating element and a supplementary ground connection extending between the feed leg and the ground plane.

16 Claims, 8 Drawing Sheets

(56) References Cited

U.S. PATENT DOCUMENTS

| | | | | |
|---|---|---|---|---|
| 2012/0068893 | A1* | 3/2012 | Guterman | H01Q 1/2266 343/702 |
| 2012/0256803 | A1* | 10/2012 | Cozzolino | H01Q 1/36 343/821 |
| 2013/0002510 | A1* | 1/2013 | Azulay | H01Q 1/243 343/860 |
| 2013/0234896 | A1* | 9/2013 | Sharawi | H01Q 9/0421 343/700 MS |

OTHER PUBLICATIONS

An International Search Report and Written Opinion both dated Oct. 15, 2014, which issued during the prosecution of Applicant's PCT/IL2014/050563.

Satti C et al., "integration of wideband differential coupler with wideband differential MIMO antenna", (master thesis), Nov. 21, 2011, Linkoping University, Sweden, [online],[retrieved on Sep. 22, 2014].

* cited by examiner

BROADBAND MULTIPLE-INPUT MULTIPLE-OUTPUT ANTENNA

REFERENCE TO RELATED APPLICATIONS

Reference is hereby made to U.S. Provisional Patent Application 61/838,425, entitled MIMO ANTENNA, filed Jun. 24, 2013, the disclosure of which is hereby incorporated by reference and priority of which is hereby claimed pursuant to 37 CFR 1.78(a)(4) and (5)(i).

FIELD OF THE INVENTION

The present invention relates generally to antennas and more particularly to multiple-input multiple-output (MIMO) antennas.

BACKGROUND OF THE INVENTION

Various types of MIMO antennas are known in the art.

SUMMARY OF THE INVENTION

The present invention seeks to provide an improved MIMO antenna having broadband performance.

There is thus provided in accordance with a preferred embodiment of the present invention an antenna, including a ground plane, a first radiating element mounted on the ground plane, a second radiating element mounted on the ground plane in spaced relation to the first radiating element, each one of the first and second radiating elements including a feed leg for feeding the radiating element, a ground leg for grounding the radiating element, an origami-like folded element having a first end and a second end, the first end being connected to the feed leg, the second end being capacitively coupled to the radiating element and a supplementary ground connection extending between the feed leg and the ground plane.

Preferably, each one of the first and second radiating elements includes an upper radiative meandering portion distal from the ground plane, the feed and ground legs extending from the upper radiative meandering portion.

Preferably, the feed leg is connected to the upper radiative meandering portion at a feeding region and the ground leg is connected to the upper radiative meandering portion at a grounding region, the feeding region being separated from the grounding region by an electrical distance along the upper radiative meandering portion of $\lambda/4$, wherein $\lambda$ corresponds to a wavelength of radiation of the upper radiative meandering portion.

Preferably, the antenna also includes a first coupling portion extending from the feed leg in a direction away from the supplementary ground connection, the first coupling portion being capacitively coupled to the ground plane.

Preferably, the antenna further includes a second L-shaped coupling portion extending from the upper radiative meandering portion in a direction towards the ground plane, the second L-shaped coupling portion being capacitively coupled to the ground plane.

Preferably, the upper radiative meandering portion in combination with the first and second coupling portions and the origami-like folded element radiates in a low-frequency range.

Preferably, the low-frequency range spans 698-960 MHz.

Preferably, the origami-like folded element additionally radiates in a high-frequency range. Preferably, the high-frequency range spans 1710-2700 MHz.

Preferably, the first radiating element is fed by a first input port and the second radiating element is fed by a second input port.

In accordance with a preferred embodiment of the present invention, the antenna also includes an isolation element for electrically isolating between the first and second radiating elements.

Preferably, the isolation element includes a conductive element.

Preferably, the isolation element includes a strip located is spaced relation to the first and second radiating elements.

Preferably, the antenna also includes a radome, the isolation element being mounted on the radome.

Preferably, the ground plane includes sculpted edges for improving isolation between the first and second radiating elements.

In accordance with a preferred embodiment of the present invention, the upper radiative meandering portion includes an angularly bent structure lying in a first plane and defining inner orthogonally angled corner portions, the angularly bent structure including a first and a second orthogonally angled outer corner and a third and a fourth beveled outer corner, a length of a bevel of the third beveled outer corner being greater than a length of a bevel of the fourth beveled outer corner.

Further in accordance with a preferred embodiment of the present invention, the feed leg extends from an intermediate point along the angularly bent structure, the intermediate point being inset from the third beveled outer corner, the feed leg including a first elongate portion lying in a second plane, perpendicular to the first plane, the first elongate portion including an upper first stub portion proximal to the angularly bent structure and a lower bent segment proximal to the ground plane.

Still further in accordance with a preferred embodiment of the present invention, the origami-like folded element includes a second tapered portion extending from the lower bent segment and lying in a third plane, parallel to the first plane and perpendicular to the second plane, the second tapered portion including a circular terminal section, a third acutely angled portion extending from the circular terminal section, a fourth portion contiguous with the third acutely angled portion and bent in a direction away from the angularly bent structure, the fourth portion including an inverted arrow-like structure including a lower head segment having an apex contiguous with the third acutely angled portion and an upper stem segment having a beveled edge, and a fifth portion contiguous with the beveled edge and acutely bent with respect thereto, the fifth portion including an orthogonal corner portion and a perpendicularly bent tab, the perpendicularly bent tab terminating in a second open-ended stub portion and lying in a fourth plane, parallel to and offset from the first plane.

Yet further in accordance with a preferred embodiment of the present invention, the supplementary ground connection includes a sixth straight portion extending perpendicularly from a point immediately above the lower bent segment and a seventh portion extending from the sixth straight portion and perpendicularly bent with respect thereto, the seventh portion lying in a plane perpendicular to the first plane and including a bent L-shaped foot terminating at the ground plane.

Further in accordance with a preferred embodiment of the present invention, the ground leg extends from a location between the second orthogonally angled outer corner and the fourth beveled outer corner, the ground leg including a sheet element lying in a fifth plane perpendicular to the first plane and having a setback lower edge including two step-like recessions formed therein.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
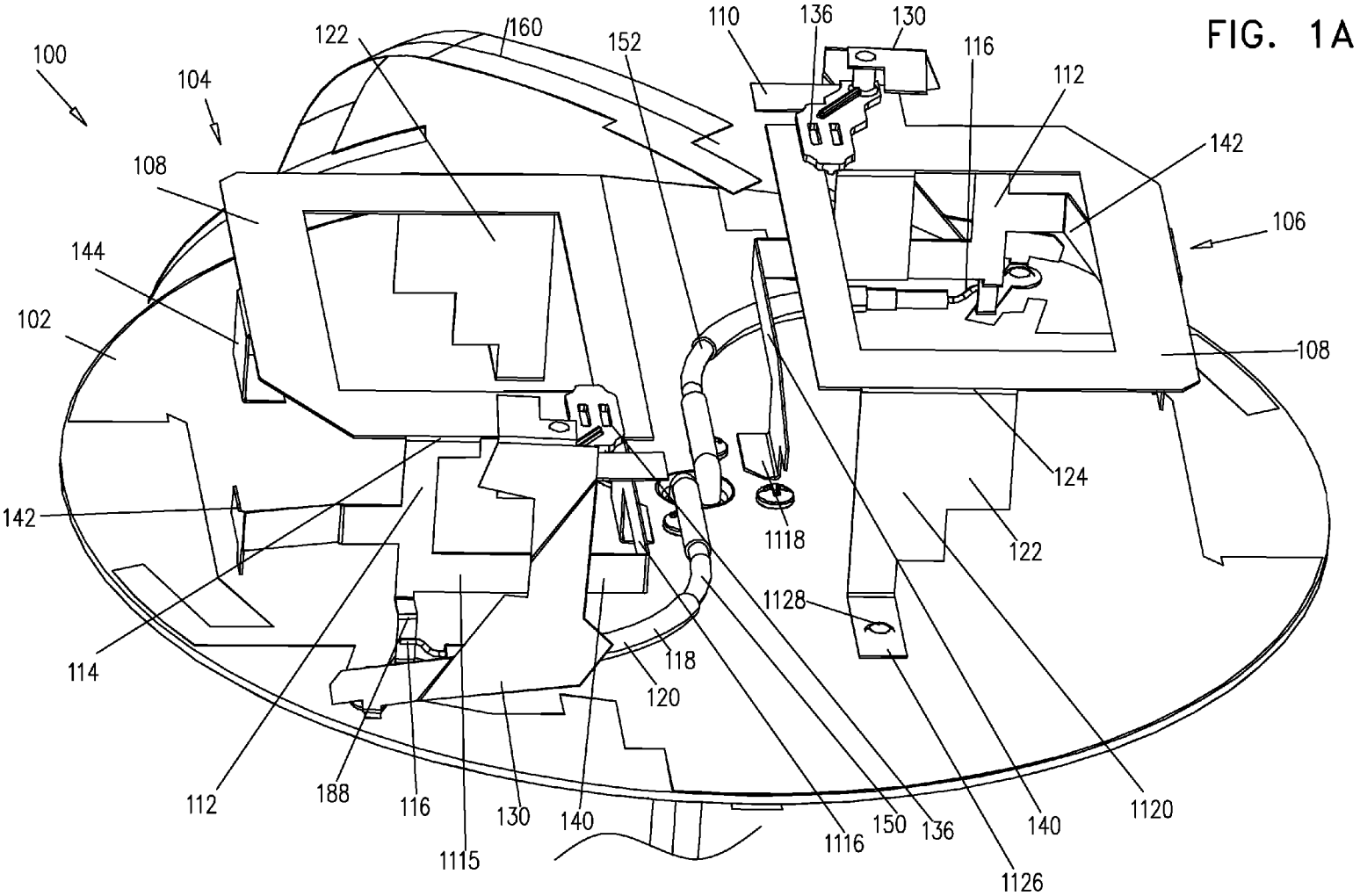
FIGS. 1A, 1B and 1C are simplified respective perspective, side and top view illustrations of an antenna constructed and operative in accordance with a preferred embodiment of the present invention.
Figure 1B:
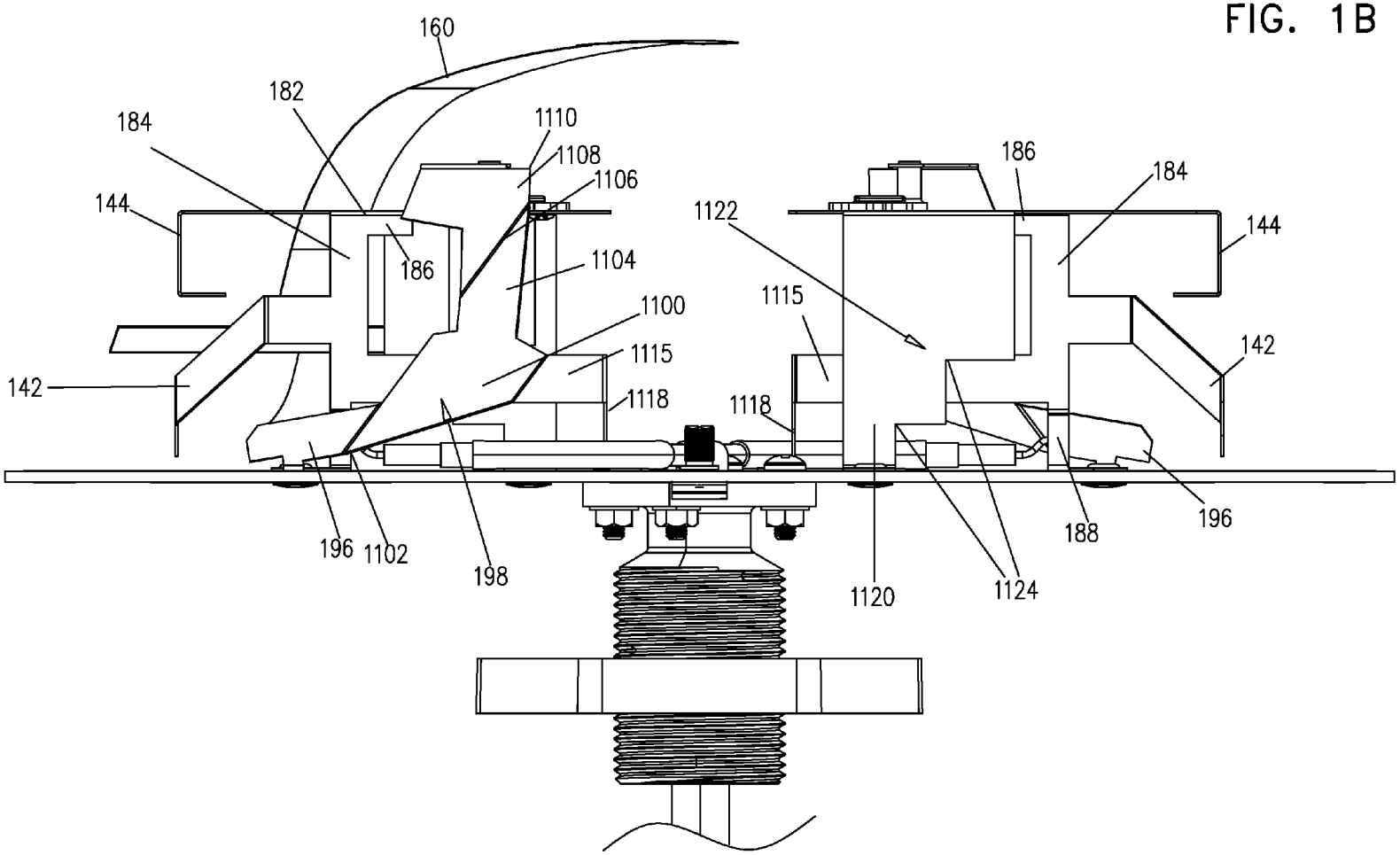
Figure 1C:
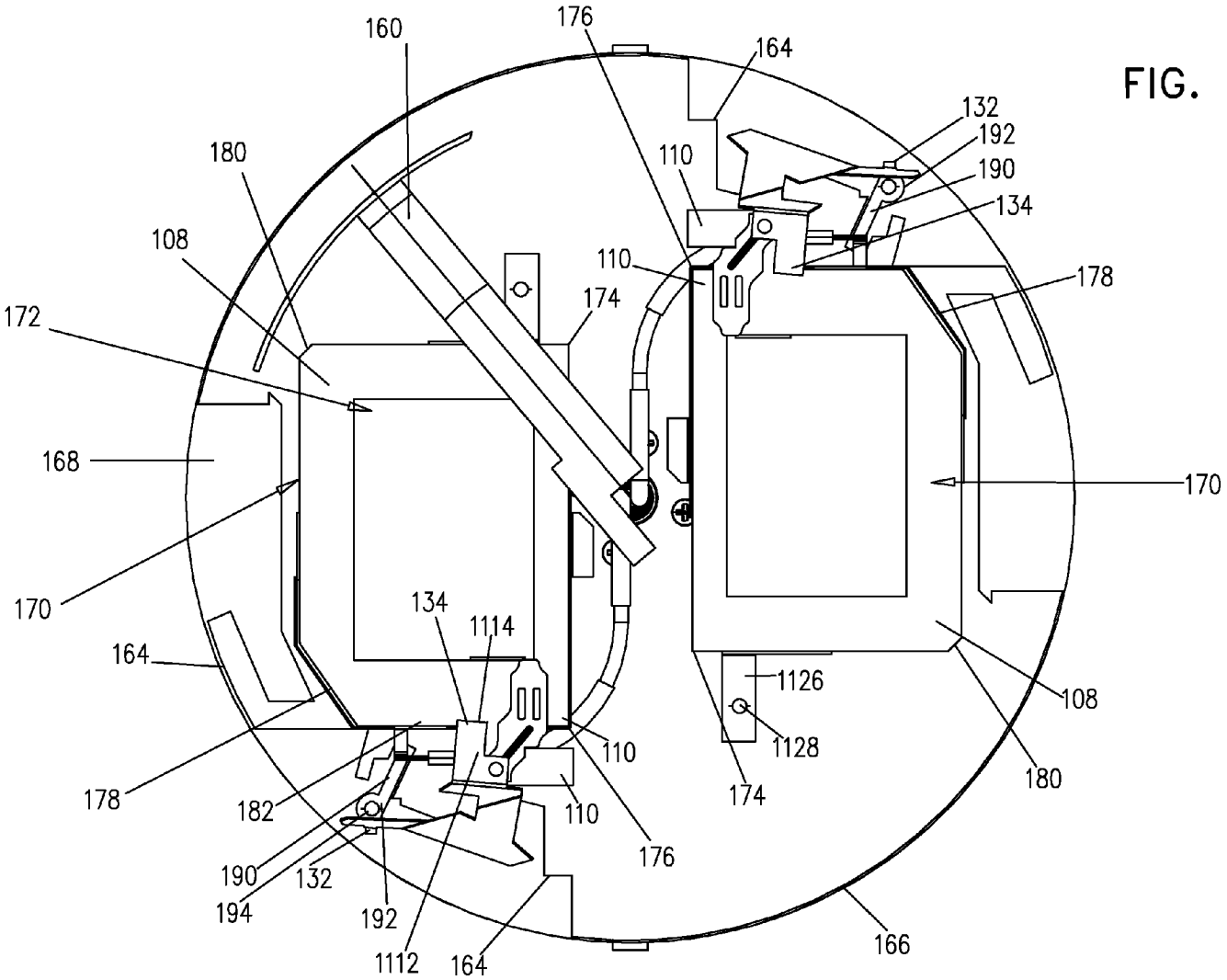
Figure 1D:
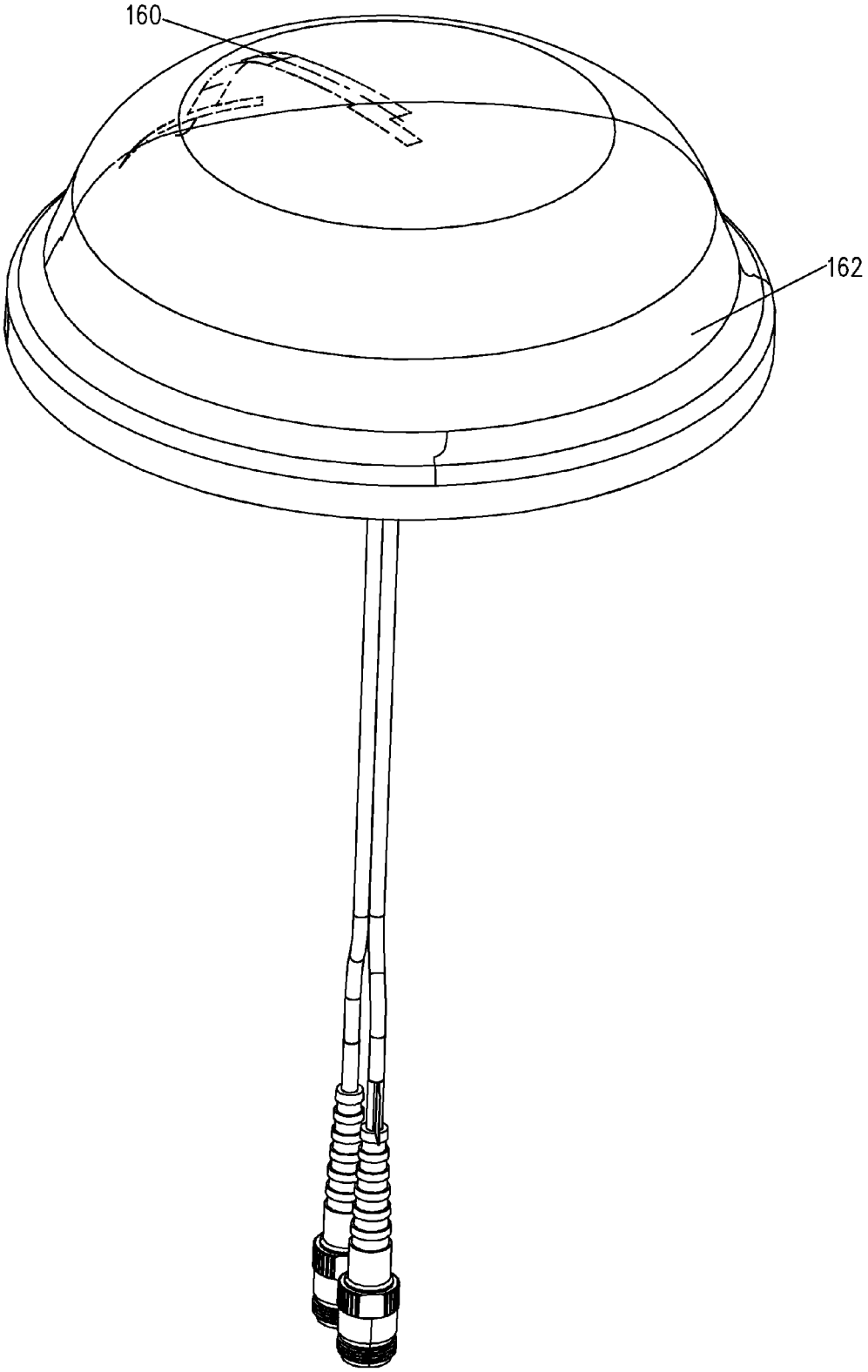
FIG. 1D is a simplified assembled perspective view of an antenna of the type illustrated in FIGS. 1A-1C.
Figure 2A:
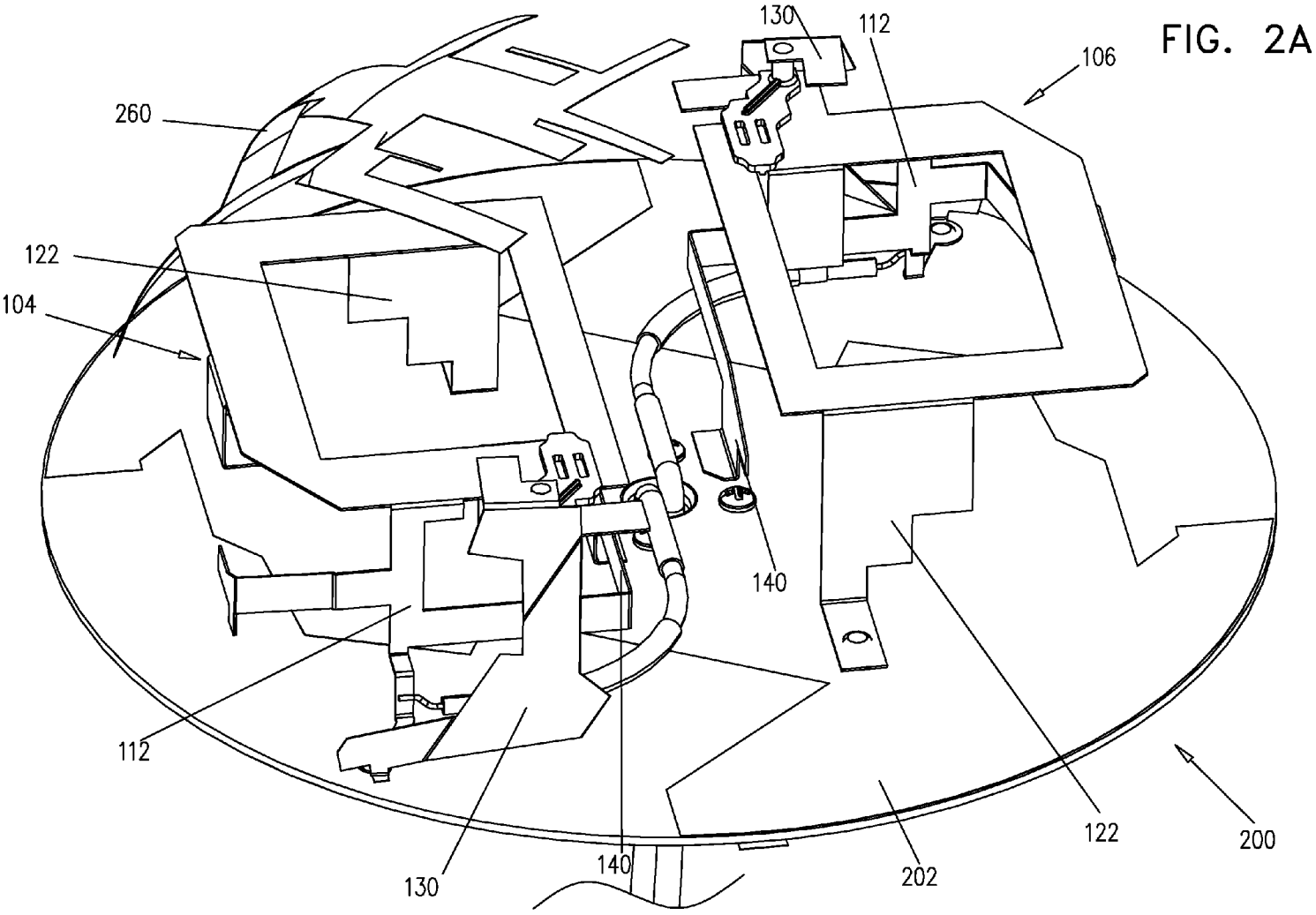
FIGS. 2A, 2B and 2C are simplified respective perspective, side and top view illustrations of an antenna constructed and operative in accordance with another preferred embodiment of the present invention.
Figure 2B:
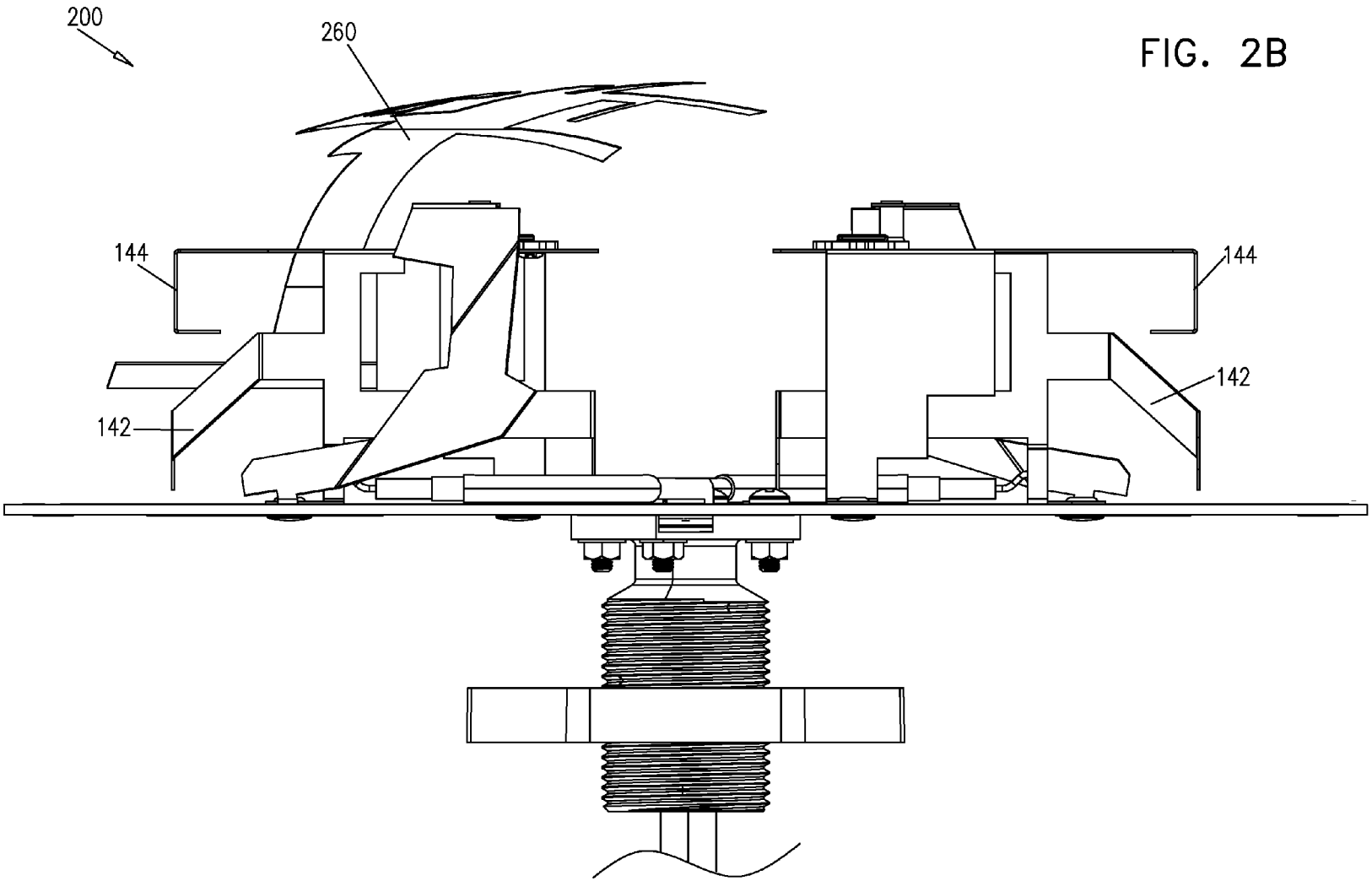
Figure 2C:
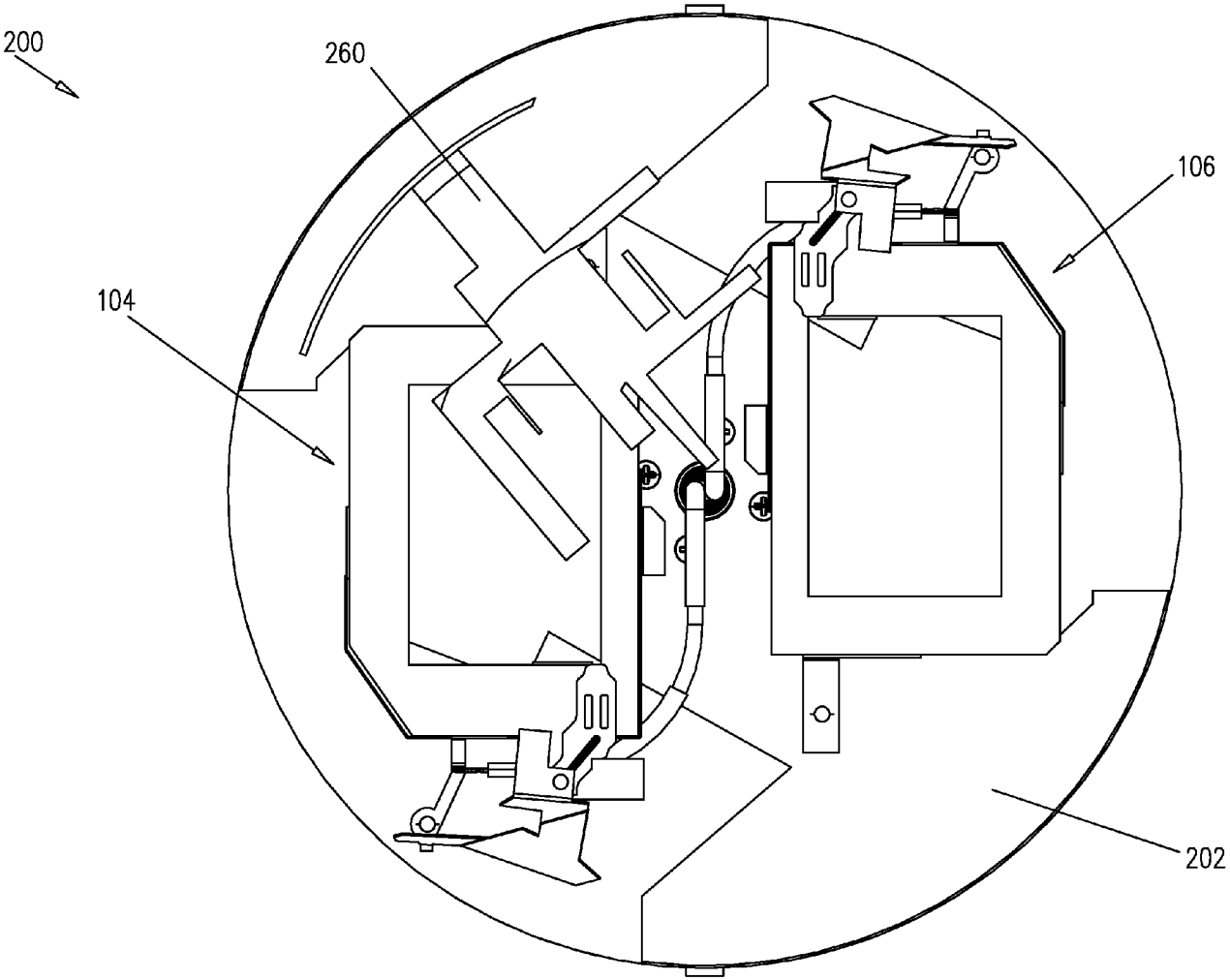
Figure 2D:
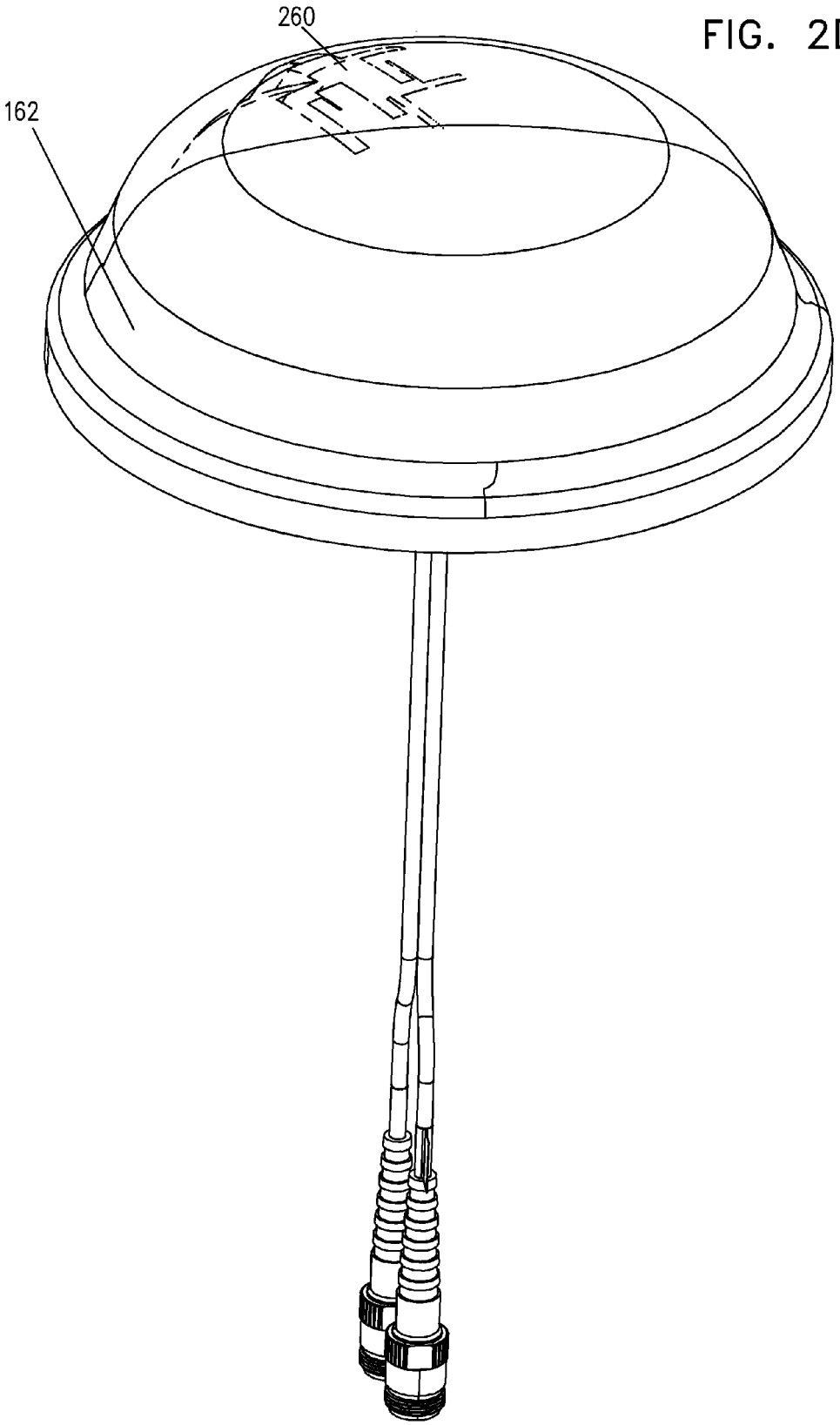
FIG. 2D is a simplified assembled perspective view of an antenna of the type illustrated in FIGS. 2A-2C.

Reference is now made to FIGS. 1A, 1B and 1C, which are simplified respective perspective, side and top view illustrations of an antenna constructed and operative in accordance with a preferred embodiment of the present invention; and to FIG. 1D, which is a simplified assembled perspective view of an antenna of the type illustrated in FIGS. 1A-1C.

As seen in FIGS. 1A-1D, there is provided an antenna 100, preferably including a ground plane 102 and a first radiating element 104 and second radiating element 106 mounted thereon. Second radiating element 106 is preferably located 10 adjacent to and spaced apart from first radiating element 104. As appreciated most clearly from consideration of FIGS. 1A and 1C, first radiating element 104 preferably has a generally similar structure to that of second radiating element 106 and is preferably disposed on ground plane 102 so as to be rotated approximately 180° and somewhat translated with respect to second radiating element 106. First and second 15 radiating elements 104 and 106 may have identical structures, as shown in the case of antenna 100. Alternatively, first and second radiating elements 104 and 106 may generally resemble each other in relevant aspects thereof but have minor variations with respect to each other, as will be obvious to one skilled in the art.

Due to the generally similar structures of first and second radiating elements 104 and 106, first and second radiating elements 104 and 106 preferably radiate in generally similar frequency bands. It is appreciated that as a result of the provision of two spatially separated radiating elements operating in a common frequency band, namely first and second radiating elements 104 and 106, antenna 100 preferably operates as a spatial-diversity antenna, thus improving the performance thereof in comparison to an antenna including only a single radiating element.

First and second radiating elements 104 and 106 are preferably each formed as complex radiating elements, preferably each comprising an upper meandering portion 108. As seen most clearly in FIG. 1C, upper meandering portion 108 preferably comprises an open-ended structure having a first and a second terminus 110. First and second terminus 110 are preferably separated by a gap, such that upper meandering portion 108 does not form a closed loop. In the illustrated embodiment of upper meandering portion 108, upper meandering portion 108 is shown to comprise an angular structure having orthogonally bent corner portions. It is appreciated, however, that this configuration of upper meandering portion 108 is exemplary only, and that upper meandering portion may be formed in a variety of configurations, including sinuously curved, planar or non-planar configurations.

Upper meandering portion 108 is preferably fed by way of a feed leg 112 extending from upper meandering portion 108 at a feeding region 114. Feed leg 112 preferably receives a radio-frequency (RF) signal by way of an inner conductor 116 of a coaxial cable 118 connected thereto. In the illustrated embodiment of antenna 100, inner conductor 116 is shown to be connected to feed leg 112 at a base end thereof. It is appreciated, however, that the position of the connection point of inner conductor 116 of coaxial cable 118 to feed leg 112 may be readily adjusted, depending on the impedance matching requirements of antenna 100. An outer sheath 120 of coaxial cable 118 preferably rests upon and is galvanically connected to ground plane 102.

Upper meandering portion 108 is preferably grounded by way of a ground leg 122 extending from upper meandering portion 108 at a grounding region 124. It will be readily appreciated by one skilled in the art that the structure of each one of first and second radiating elements 104 and 106, including an upper meandering radiative portion 108 having a feed leg 112 and a ground leg 122 extending therefrom, is somewhat analogous to that of a Planar Inverted F-Antenna (PIFA). However, first and second radiating elements 104 and 106 differ from conventional PIFAs in at least several significant aspects thereof, as will be detailed henceforth.

Grounding region 124 is preferably separated from feeding region 114 by an electrical distance of approximately $\lambda/4$ along upper meandering portion 108, where $\lambda$ is a wavelength corresponding to a frequency range of operation of upper meandering portion 108 and the electrical distance is measured along a closed path along upper meandering portion 108 between grounding region 124 and feeding region 114. The separation of grounding region 124 from feeding region 114 by an electrical distance of approximately $\lambda/4$ is a particular feature of a preferred embodiment of the present invention and is in contrast to the separation between the ground and feed points 30 employed in conventional PIFAs, which separation is typically much smaller than $\lambda/4$. The separation of grounding region 124 from feeding region 114 by an electrical distance of the order of $\lambda/4$ gives rise to an extremely wide bandwidth of operation of antenna 100, the range of which will be detailed henceforth.

Each one of first and second radiating elements 104 and 106 further preferably includes an origami-like folded element 130 having a first end 132 and a second end 134. First end 132 is preferably connected to feed leg 112 at the base 5 thereof, in proximity to the connection point of inner conductor 116 of coaxial cable 118. Second end 134 is preferably positioned in close proximity to but spatially offset from upper meandering portion 108, so as to be capacitively coupled thereto. Folded element 130 is preferably not directly galvanically connected to ground plane 102.

Folded element 130 may be configured so as to resonate in both a low- and high-frequency band of operation of antenna 100 and so as to improve the Voltage Standing Wave Ratio (VSWR) thereof. It is appreciated that the origami-like intricately folded structure of folded element 130 has been found to optimize the operation thereof; however, folded element 130 may be configured in a variety of folded formations, depending on the operating and design requirements thereof. It is further appreciated that although upper meandering portion 108, feed leg 112, ground leg 122 and folded element 130 have been distinguished between herein for the purpose of description of the respective functions thereof, upper meandering portion 108, feed leg 112, ground leg 122 and folded element 130 may be formed as a monolithic element.

Second end 134 of folded element 130 may be suspended above upper meandering portion 108. A preferable separation between second end 134 of folded element 130 and upper meandering portion 108 has been found to lie in the range of 5-8 mm. Second end 134 of folded element 130 may be supported in spaced relation to upper meandering portion 108 by way of a dielectric spacer element 136, which dielectric spacer element 136 may be slotted, screwed or otherwise attached to upper meandering portion 108. Alternatively, folded element 130 may be sufficient rigid so as to obviate the need for dielectric spacer element 136. Dielectric spacer element 136 may be located so as to overly a part of the gap separating first and second terminus 110 of upper meandering portion 108, as seen most clearly in FIGS. 1A and 1C, wherein the gap separating first and second terminus 110 of upper meandering portion 108 extends beneath dielectric spacer element 136 and is thus partially concealed thereby.

Each one of first and second radiating elements 104 and 106 further preferably includes a supplementary ground connection 140, preferably extending between an intermediate point along feed leg 112 and ground plane 102. The provision of a supplementary ground connection 140 in antenna 100 is a particular feature of a preferred embodiment of the present invention, and is in contrast to conventional PIFAs which typically include only a single ground connection. The provision of supplementary ground connection 140 preferably serves to tune the operation of antenna 100 and thereby optimize the performance thereof.

In operation of antenna 100, upper meandering portion 108 in combination with folded element 130 preferably resonates in a low-frequency range spanning approximately 698-960 MHz. The low-frequency operation of radiating elements 104 and 106 may be further improved by the provision of a first and a second additional coupling portion 142, 144. First coupling portion 142 preferably comprises an angled portion extending from feed leg 112 in a direction away from supplementary ground connection 140. Second coupling portion 144 preferably comprises a generally L-shaped portion extending from an intermediate point along upper meandering portion 108 and spaced apart from ground plane 102 by a distance in the range of approximately 25-30 mm. First and second coupling portions 142 and 144 are preferably capacitively coupled to ground plane 102 and tuned so as to resonate in frequencies spanning approximately 800-960 MHz, thereby augmenting the low-frequency range of operation of first and second radiating elements 104 and 106.

Furthermore, folded element 130 preferably resonates in a high-frequency range spanning approximately 1710-2700 MHz. Each one of radiating elements 104 and 106 thus operates as a broadband radiating element, having a frequency range of operation spanning approximately 698-960 and 1710-2700 MHz. First radiating element 104 and second radiating element 106 are preferably respectively connected to an individual first and second input port 150, 152. Antenna 100 thus constitutes an advantageously broadband dual-input, dual-output or MIMO antenna, offering spatial diversity due to the co-location of first and second radiating elements 104 and 106.

It is appreciated that the above-delineated low- and high-frequency ranges of operation of antenna 100 are exemplary only and may be readily adjusted by way of adjustment to various parameters of antenna 100, including the dimensions and arrangement thereof, as is well known in the art.

In order to improve isolation between first and second radiating elements 104 and 106, an isolation element 160 may be included in antenna 100. Isolation element 160 preferably comprises a conductive element and is preferably located in spaced relation to first and second radiating elements 104 and 106. In the embodiment of antenna 100 illustrated in FIGS. 1A-1D, isolation element 160 is shown to be embodied as a strip-like element, attached to a radome 162 housing antenna 100. Isolation element 160 may be asymmetrically positioned with respect to first and second radiating elements 104 and 106, as seen most clearly in FIG. 1C.

Isolation between first and second radiating elements 104 and 106 may be further improved as a result of a particular configuration of ground plane 102. As seen most clearly in FIG. 1C, ground plane 102 may be a shaped ground plane including a multiplicity of sculpted non-uniform edges 164. The particular illustrated shape of ground plane 102 shown in FIGS. 1A-1C has been found to optimize isolation between first and second radiating elements 104 and 106 as well as to improve the VSWR of antenna 100 over both the low- and high-frequency ranges of operation thereof. Ground plane 102 may include sculpted non-uniform edges 164 in addition to at least one continuously curved edge 166. Ground plane 102 may be mounted on a dielectric substrate such as a printed circuit board (PCB) 168, and may be formed on a single surface thereof. Alternatively, portions of ground plane 102 may be formed on multiple surfaces of PCB 168.

In accordance with a particularly preferred embodiment of the present invention, upper meandering portion 108 of first and second radiating elements 104 and 106 preferably comprises an angularly bent structure 170 lying in a first plane and defining inner orthogonally angled corner portions 172, as seen most clearly in FIG. 1C. Angularly bent structure 170 preferably includes a first and a second orthogonally angled outer corner 174, 176 and a third and a fourth beveled outer corner 178, 180. A length of a bevel of third beveled outer corner 178 is preferably greater than a length of a bevel of fourth beveled outer corner 180.

Feed leg 112 preferably descends from an intermediate point 182 along angularly bent structure 170, which point 182 is inset from third beveled outer corner 178. As seen most clearly in FIG. 1B, feed leg 112 preferably comprises a first elongate portion 184 lying in a second plane, generally perpendicular to the first plane defined by angularly bent structure 170. First elongate portion 184 includes a first stub portion 186 proximal to angularly bent structure 170 and a lower bent segment 188 proximal to ground plane 102. Inner conductor 116 of coaxial cable 118 is preferably connected to feed leg 112 at lower bent segment 188.

A second tapered portion 190 preferably extends from lower bent segment 188 of first elongate portion 184, as seen most clearly in FIG. 1C. Second tapered portion 190 preferably lies in a third plane, parallel to the first plane and perpendicular to the second plane and extends along a surface of ground plane 102. Second tapered portion 190 preferably has a circular terminal section 192 adapted for insertion therein of a screw 194 for securing second tapered portion 190 to PCB 168.

A third acutely angled portion 196 preferably extends from circular terminal section 192. As seen most clearly in FIG. 1B, third acutely angled portion 196 preferably widens and bends in a direction away from angularly bent structure to form a fourth portion 198. Fourth portion 198 has an inverted arrow-like structure comprising a lower head segment 1100 having an apex 1102 contiguous with third acutely angled portion 196 and an upper stem segment 1104 having a beveled edge 1106. Upper stem segment 1104 preferably bends acutely to form a fifth portion 1108 including an orthogonal corner portion 1110 and a perpendicularly bent tab 1112 terminating in a second open-ended stub portion 1114. Perpendicularly bent tab 1112 preferably lies in a fourth plane, parallel to and offset from the first plane defined by angularly bent structure 170.

It is appreciated that the above-described structure of second tapered portion 190-bent tab 1112 comprises a particularly preferred embodiment of origami-like folded element 130.

A sixth straight portion 1115 preferably extends perpendicularly from a point immediately above lower bent segment 188. Sixth straight portion 1115 preferably bends perpendicularly in turn to form a seventh portion 1116 comprising a bent L-shaped foot 1118 terminating at ground plane 102, as seen most clearly for second 30 radiating element 106 in FIG. 1A. It is appreciated that the above-described structure of sixth straight portion 1115-L-shaped foot 1118 comprises a particularly preferred embodiment of supplementary ground connection 140.

Further in accordance with a particularly preferred embodiment of the present invention, ground leg 122 preferably extends from a location between first orthogonally angled outer corner 174 and fourth beveled outer corner 180. As seen most clearly in FIG. 1B, ground leg 122 preferably comprises a sheet element 1120 lying in a fifth plane, generally perpendicular to the first plane. Sheet element 1120 preferably includes a setback lower edge 1122 comprising two step-like recessions 1124 formed therein. Ground leg 122 is preferably attached to ground plane 102 by way of a perpendicularly bent third stub 1126 preferably secured to ground plane 102 by a screw 1128.

It is appreciated that the particular respective configurations of isolation element 160 and sculpted edges 164 of ground plane 102, leading to improved isolation and increased VSWR of antenna 100, are exemplary only and may be readily modified in accordance with the desired operating characteristics of the antenna. Thus, isolation element 160 may be embodied in a variety of forms and located at a variety of locations within antenna 100. By way of non-limiting example, isolation element 160 may have a variety of shapes and lengths, be symmetrically or asymmetrically positioned with respect to first and second radiating elements 104 and 106, may overlap or be non-overlapping with first and second radiating elements 104 and 106 and may be attached to a radome or other dedicated or non-dedicated supporting structures in antenna 100. Similarly, a shape and size of ground plane 102 may be adjusted so as to alter the properties thereof.

As seen, by way of example, in the case of an antenna 200 shown in FIGS. 2A-2D and generally resembling antenna 100 in relevant aspects thereof, edges of ground plane 102 may be cut away so as to form a differently shaped ground plane 202, exhibiting somewhat modified electrical properties in comparison to ground plane 102. Additionally or alternatively, isolation element 160 may be extended and extruded so as to form a differently shaped isolation element 260, having a multiple-branched structure. It is appreciated that although differently shaped ground plane 202 and differently shaped isolation element 260 are both shown to be included in antenna 200, the shape of only one or both of the ground plane and isolation element may be modified, so as to influence antenna performance.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. An antenna comprising:

a ground plane;

a first radiating element mounted on said ground plane;

a second radiating element mounted on said ground plane in spaced relation to said first radiating element, each one of said first and second radiating elements comprising:

a feed leg for feeding said radiating element;

a ground leg for grounding said radiating element;

a folded element having a first end and a second end, said first end being connected to said feed leg, said second end being capacitively coupled to said radiating element; and a supplementary ground connection extending between said feed leg and said ground plane, wherein each one of said first and second radiating elements comprises an upper radiative meandering portion distal from said ground plane, said feed and ground legs extending from said upper radiative meandering portion, wherein said upper radiative meandering portion comprises an angularly bent structure lying in a first plane and defining inner orthogonally angled corner portions, said angularly bent structure comprising a first and a second orthogonally angled outer corner and a third and a fourth beveled outer corner, a length of a bevel of said third beveled outer corner being greater than a length of a bevel of said fourth beveled outer corner, wherein said feed leg extends from an intermediate point along said angularly bent structure, said intermediate point being inset from said third beveled outer corner, said feed leg comprising a first elongate portion lying in a second plane, perpendicular to said first plane, said first elongate portion comprising an upper first stub portion proximal to said angularly bent structure and a lower bent segment proximal to said ground plane, and wherein said folded element comprises:

a second tapered portion extending from said lower bent segment and lying in a third plane, parallel to said first plane and perpendicular to said second plane, said second tapered portion comprising a circular terminal section;

a third acutely angled portion extending from said circular terminal section;

a fourth portion contiguous with said third acutely angled portion and bent in a direction away from said angularly bent structure, said fourth portion comprising an inverted arrow-like structure comprising a lower head segment having an apex contiguous with said third acutely angled portion and an upper stem segment having a beveled edge; and a fifth portion contiguous with said beveled edge and acutely bent with respect thereto, said fifth portion comprising an orthogonal corner portion and a perpendicularly bent tab, said perpendicularly bent tab terminating in a second open-ended stub portion and lying in a fourth plane, parallel to and offset from said first plane.

2. An antenna according to claim 1, wherein said feed leg is connected to said upper radiative meandering portion at a feeding region and said ground leg is connected to said upper radiative meandering portion at a grounding region, said feeding region being separated from said grounding region by an electrical distance along said upper radiative meandering portion of $\lambda/4$, wherein $\lambda$ corresponds to a wavelength of radiation of said upper radiative meandering portion.

3. An antenna according to claim 1, and also comprising a first coupling portion extending from said feed leg in a direction away from said supplementary ground connection, said first coupling portion being capacitively coupled to said ground plane.

4. An antenna according to claim 3, and also comprising a second L-shaped coupling portion extending from said upper radiative meandering portion in a direction towards said ground plane, said second L-shaped coupling portion being capacitively coupled to said ground plane.

5. An antenna according to claim 4, wherein said upper radiative meandering portion in combination with said first and second coupling portions and said folded element radiates in a low-frequency range.

6. An antenna according to claim 5, wherein said low-frequency range spans 698-960 MHz.

7. An antenna according to claim 5, wherein said folded element additionally radiates in a high-frequency range.

8. An antenna according to claim 7, wherein said high-frequency range spans 1710-2700 MHz.

9. An antenna according to claim 1, wherein said first radiating element is fed by a first input port and said second radiating element is fed by a second input port.

10. An antenna according to claim 1, and also comprising an isolation element for electrically isolating between said first and second radiating elements.

11. An antenna according to claim 10, wherein said isolation element comprises a conductive element.

12. An antenna according to claim 10, wherein said isolation element comprises a strip located is spaced relation to said first and second radiating elements.

13. An antenna according to claim 10, and also comprising a radome, said isolation element being mounted on said radome.

14. An antenna according to claim 1, wherein said ground plane comprises sculpted edges for improving isolation between said first and second radiating elements.

15. An antenna according to claim 1, wherein said supplementary ground connection comprises:

a sixth straight portion extending perpendicularly from a point immediately above said lower bent segment; and a seventh portion extending from said sixth straight portion and perpendicularly bent with respect thereto, said seventh portion lying in a plane perpendicular to said first plane and comprising a bent L-shaped foot terminating at said ground plane.

16. An antenna according to claim 15, wherein said ground leg extends from a location between said second orthogonally angled outer corner and said fourth beveled outer corner, said ground leg comprising a sheet element lying in a fifth plane perpendicular to said first plane and having a setback lower edge comprising two step-like recessions formed therein.

* * * * *